US009200470B2

(12) United States Patent
Morris

(10) Patent No.: US 9,200,470 B2
(45) Date of Patent: Dec. 1, 2015

(54) METHODS AND MEMORIAL BUOYS FOR PROVIDING MEMORIALS FOR LOVED ONES

(71) Applicant: Daniel M. Morris, Indianapolis, IN (US)

(72) Inventor: Daniel M. Morris, Indianapolis, IN (US)

( * ) Notice: Subject to any disclaimer, the term of this patent is extended or adjusted under 35 U.S.C. 154(b) by 0 days.

(21) Appl. No.: 14/121,175

(22) Filed: Aug. 11, 2014

(65) Prior Publication Data

US 2015/0050850 A1 Feb. 19, 2015

Related U.S. Application Data

(60) Provisional application No. 61/959,004, filed on Aug. 13, 2013.

(51) Int. Cl.

| | |
|---|---|
| ***B63B 22/24*** | (2006.01) |
| ***E04H 13/00*** | (2006.01) |
| ***A61G 17/08*** | (2006.01) |

(52) U.S. Cl.

CPC ..... *E04H 13/008* (2013.01); *A61G 17/08* (2013.01); *B63B 22/24* (2013.01)

(58) Field of Classification Search

CPC ..... A61G 17/08; E04H 13/00; B63B 22/24
USPC ..... 441/32, 21, 26; 27/1
See application file for complete search history.

(56) References Cited

U.S. PATENT DOCUMENTS

| | | | | |
|---|---|---|---|---|
| 3,732,602 | A * | 5/1973 | Vigh | 27/1 |
| 4,927,395 | A * | 5/1990 | Saulnier et al. | 441/26 |
| 5,127,112 | A * | 7/1992 | Brock | 27/1 |
| 5,379,499 | A * | 1/1995 | Jackson | 27/1 |
| 7,841,917 | B2 * | 11/2010 | Pritchard | 441/21 |
| 7,866,013 | B2 * | 1/2011 | Laurens | 27/1 |
| 8,920,202 | B2 * | 12/2014 | Ames et al. | 441/6 |
| 2006/0179624 | A1 * | 8/2006 | Glass | 27/1 |
| 2009/0093176 | A1 * | 4/2009 | Estrada-Lugo | 441/11 |
| 2015/0050850 | A1 * | 2/2015 | Morris | 441/32 |

* cited by examiner

*Primary Examiner* — Lars A Olson
*Assistant Examiner* — Jovon Hayes
(74) *Attorney, Agent, or Firm* — David H. Badger

(57) ABSTRACT

A memorial buoy is provided to carry the cremains of a beloved family member, friend, or pet in a water-tight buoy assembly that can be moored near the edge of a body of water adjacent a waterside dwelling to present a memorial of the decedent.

19 Claims, 5 Drawing Sheets

METHODS AND MEMORIAL BUOYS FOR PROVIDING MEMORIALS FOR LOVED ONES

This patent application claims the benefit and filing date of U.S. provisional patent application Ser. No. 61/959,004 filed Aug. 13, 2013.

FIELD OF THE INVENTION

This invention relates to memorials for deceased loved ones and respected others to be remembered, and more particularly to methods for providing memorials for cremated loved ones in a body of water where family, friends and admirers are reminded of their past associations with, and accomplishments of, the decedent.

BACKGROUND OF THE INVENTION

Many families and groups of friends and neighbors have lived, vacationed and enjoyed fellowship and the good times of life at waterside homes, and wish to continue to honor deceased members of family and friends and to be reminded of the contributions made to the joy of life by deceased members of their families and friends. Memorials erected or positioned in graveyards are remote from the venues of everyday life and from the meetings, parties and celebrations of everyday life.

Recently, cremation is becoming a popular post-death treatment of the remains of a deceased loved one, and many families choose to house the cremains of a loved one in an urn and keep their cremains in their homes.

The invention permits families, friends and admirers who have enjoyed waterside living to provide perpetual memorials adjacent their waterside homes for deceased family members, loved pets and close friends.

Applicant can find no prior record of, and knows of no prior methods for providing, with the cremains of loved ones, water-borne memorials, or memorial buoys therefor.

BRIEF SUMMARY OF THE INVENTION

The invention provides a method for providing a water-borne memorial with the cremains of a loved one that can be located in a body of water, such a lake, river, bay or inlet, adjacent, for example, a residential or vacation dwelling. Such a method includes providing a water-tight container for the cremains of a loved one with sufficient water-tight volume to float adjacent the surface of the water in which it may be placed, placing the cremains of the loved one inside the water-tight container through a closeable opening in the water-tight container, providing a closure adapted to engage the closeable opening and render the container water-tight, attaching the closure to the container to close the closeable opening and render the container water-tight, selecting a location in a body of water where family and friends of the cremated loved one frequent, such as a lakeside residence or summer home, and anchoring the water container at the selected location where it floats adjacent the surface of the water and provides a visible memorial to the cremated loved one. If desired, the memorial buoy can be provided with a memorial such as an inscription on its visible portion, an attached inscribed plate, a religious symbol, such as a cross, or other remembrance.

The invention also comprises a memorial buoy for cremains, which can be used in the practicing the method of the invention. Such a memorial buoy can comprise a buoy assembly forming a water-tight interior for carrying the cremains of a deceased loved one, a sealable opening for insertion of the cremains within the water-tight interior, and a closure for closing and rendering the sealable opening water-tight. The water-tight container can be provided with the buoyancy needed for support of the buoy assembly adjacent the surface of a body of water in which it is placed and the display of any memorial may carry, and the cremains will provide ballast for the buoy assembly. The memorial buoy can carry a cremains holder in its water-tight interior, if desired, and such a cremains holder can itself water-tight if desired. The buoy assembly can also be provided with means for anchoring the buoy assembly in a selected location for any memorial it may carry.

One simple buoy assembly of the invention can comprise a lower container, which can have any cross-sectional shape, into which the cremains are poured and provide ballast while the empty container portion above the cremains provides buoyancy to float the buoy assembly at a desired height in the water. A closure is then joined to the open top of the container in a water-tight connection to prevent water from entering the container and reaching the cremains.

If desired, the cremains can be placed in an appropriate separate cremains holder, and both the cremains and cremains holder can then be placed in the lower container. To allow the cremains and cremains holder to be removed from the buoy assembly for placement within the home of the decedent's surviving family, e.g., during the cold months of the year, the upper portion of the lower container portion can be provided with a sealable surface including a seal member, and the closure can be provided with a mating sealable surface so the container closure can be removable but provide a water-tight container when fastened onto the mating sealable surface edge of the lower container. Thus, such a buoy assembly can have a sealable opening for insertion of the cremains or cremains holder within its water-tight interior and provide the buoyancy for supporting the buoy assembly adjacent the surface of a body of water as a memorial. The separate cremains holder, if used, can comprise, for example, a container with a fitting lid, which may also adapted to form a water-tight seal for the enclosed cremains.

In another buoy assembly, the buoy assembly can be formed with a container body, which can have any cross-sectional shape, with one preferred cross-section being circular. The container end which will be supported by the buoy assembly adjacent the surface of the water in which it is placed will carry an upper end piece fastened to the container body with a peripheral water-tight connection and will provide the sealable opening of the buoy assembly. The upper end piece can include a central opening formed to engage and support a cremains holder centrally within the container body, can further include a sealable end surface around the sealable opening of the buoy assembly, and can provide an outer surface portion with a circular cross-section which can provide a cylindrical threaded outer surface around a sealable end surface and the central opening. In such a buoy assembly an end closure with a cylindrical skirt with internal threads that engage the cylindrical threaded outer surface of the upper end piece and a sealable inner surface can be screwed onto the threaded outer surface of the upper end piece to close the sealable opening. A seal sized for sealing engagement with the sealable end surface of the upper end piece and sealable inner surface of the end closure cap seals the sealable opening of the container as the closure cap is screwed onto the upper end piece. Thus, the closure cap may be screwed onto the upper end piece and seal the sealable opening to provide the water-tight interior of the buoy assembly and may be unscrewed from the upper end piece to permit access to and, if desired, insertion and removal of the cremains holder into and from the buoy assembly.

The buoy assembly can have any desired shape and finish, preferably a shape that is both attractive and functional, e.g., spherical, and can be manufactured from any material that resists corrosion in water and can provide a water-tight interior for cremains. The water-tight interior of the buoy assembly is dimensioned to provide buoyancy selected to carry the memorial buoy adjacent the surface of a body of water into which is inserted, and preferably may be provided with buoyancy selected to carry the memorial buoy with the sealable opening above the water's surface.

Other features and advantages of memorial buoys of this invention will become apparent from the drawings of the invention and more detailed description of embodiments of the invention that follow.

Further embodiments of memorial buoy assemblies of the invention and variations of their parts and assemblies will be apparent to those skilled in the art from the drawings and the further more detailed description of the illustrated embodiments follows.

MORE DETAILED DESCRIPTION OF THE INVENTION

Figure 1:
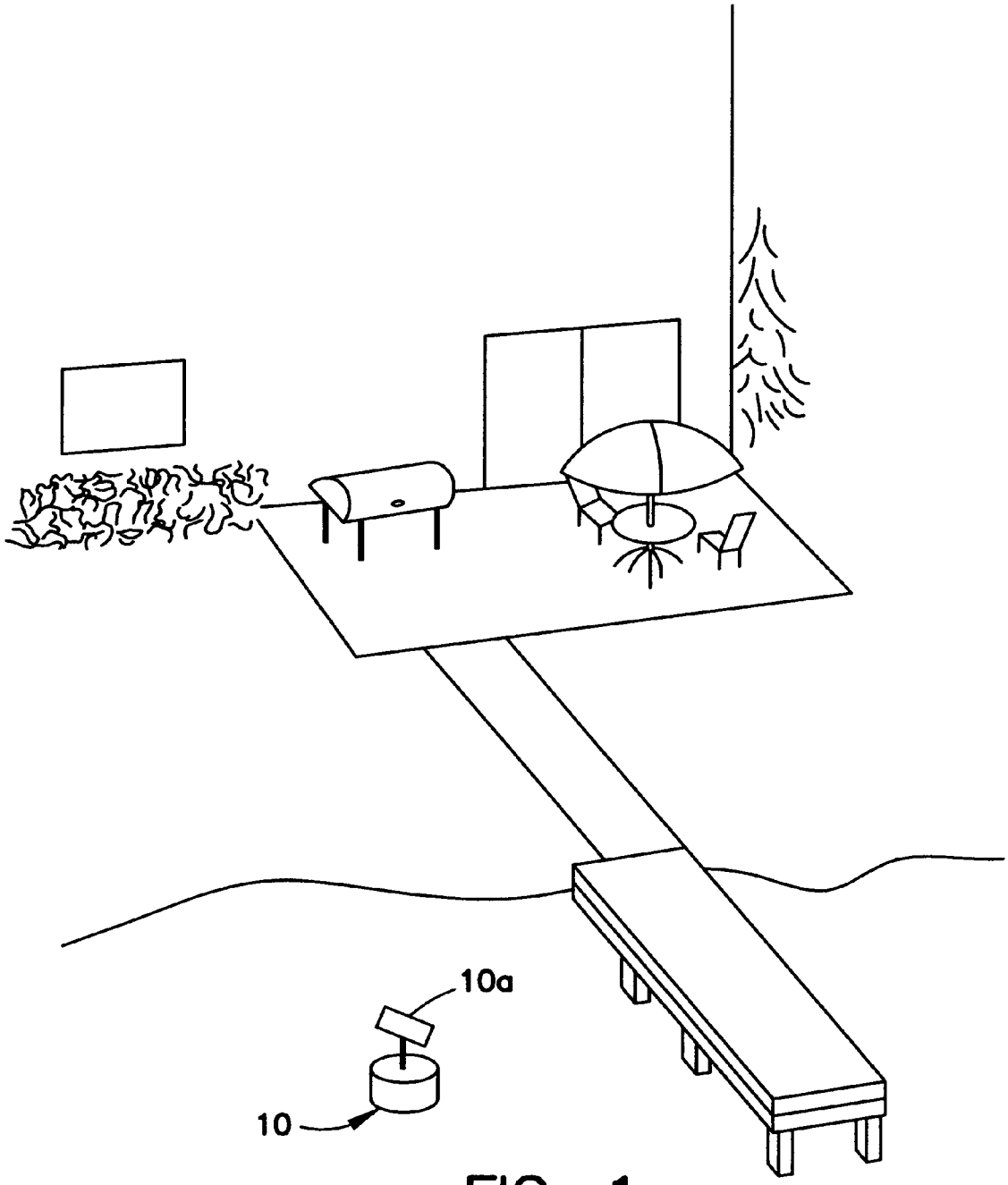
FIG. 1 is an illustration of a memorial buoy assembly of the invention anchores near the shore and and boat dock of a lake side home where a memorial plaque atop the buoy assembly one is present as a reminder of a deceased loved one.

FIG. 1 illustrates one application of the invention. As shown in FIG. 1, a memorial buoy 10 is anchored to the bottom of a lake, or other body of water, adjacent a lakeside dwelling and its boat dock and carries a memorial plaque 10*a* above the water's surface where it can be observed by people enjoying the lake as a constant reminder of the decedent and the joy the decedent brought to his, or her, family and friends. The memorial plaque 10*a* can carry any message memorializing the decedent or, if desired, a different memorial may be presented by, or inscribed on, the top of the memorial buoy, such as a religious symbol or quotation. The memorialized decedent can be a loved one, either a person or a pet, or a respected associate or friend.

As illustrated in the drawings and the following description of the invention, the buoy assembly itself can have many varied designs and part arrangements and can be made from many materials and many manufacturing methods in providing a water-tight container for the cremains of a decedent.

Figure 2:
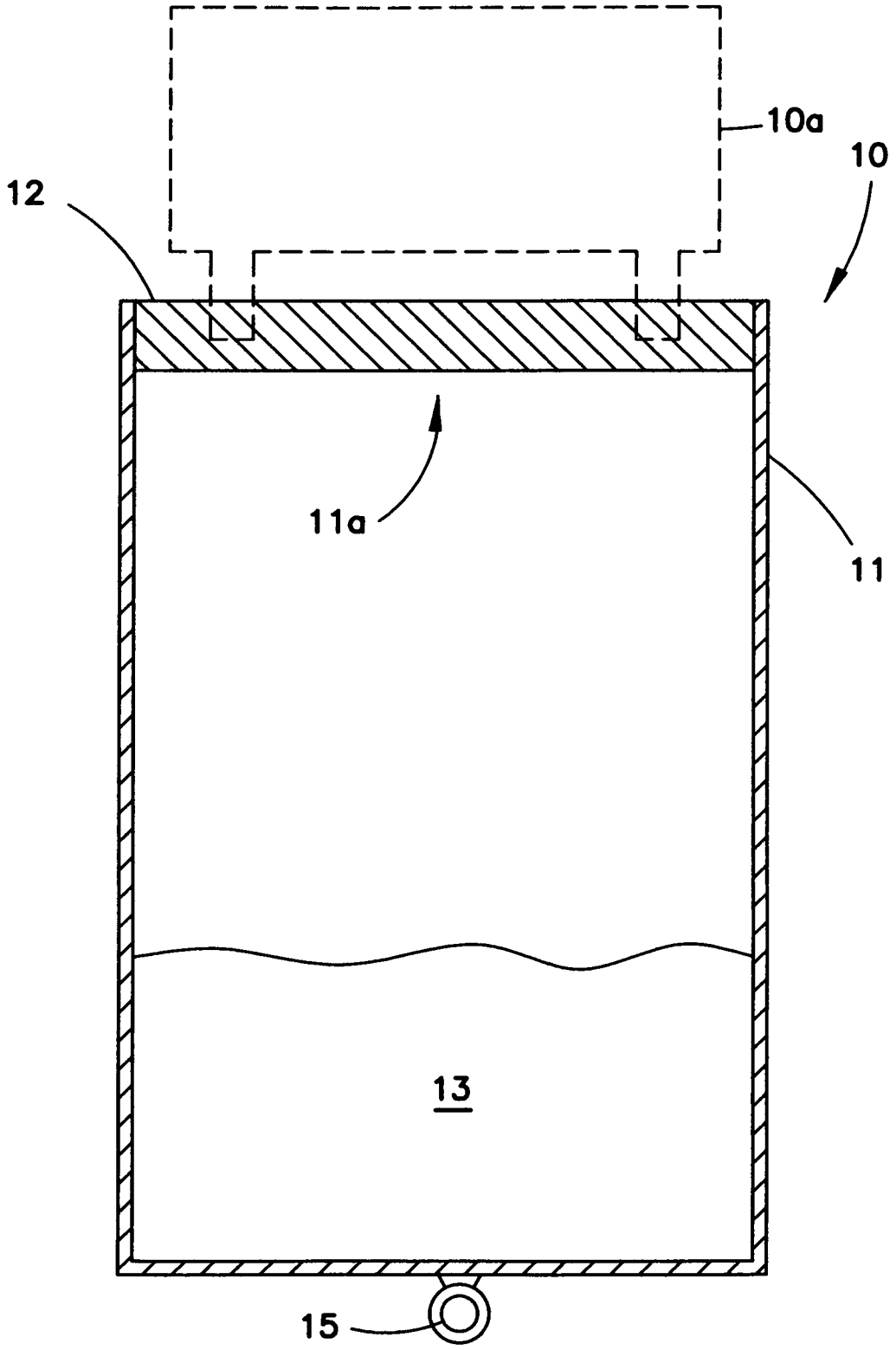
FIG. 2 is cross-sectional drawing though the central axis of a simple form of a memorial buoy assembly of the invention including a contained decedent's cremains, omitting an illustration of a memorial plaque or statue, which can have many desired forms and be attached to the top of the buoy assembly, as indicated generally by dashed lines, by any convenient method.
Figure 3:
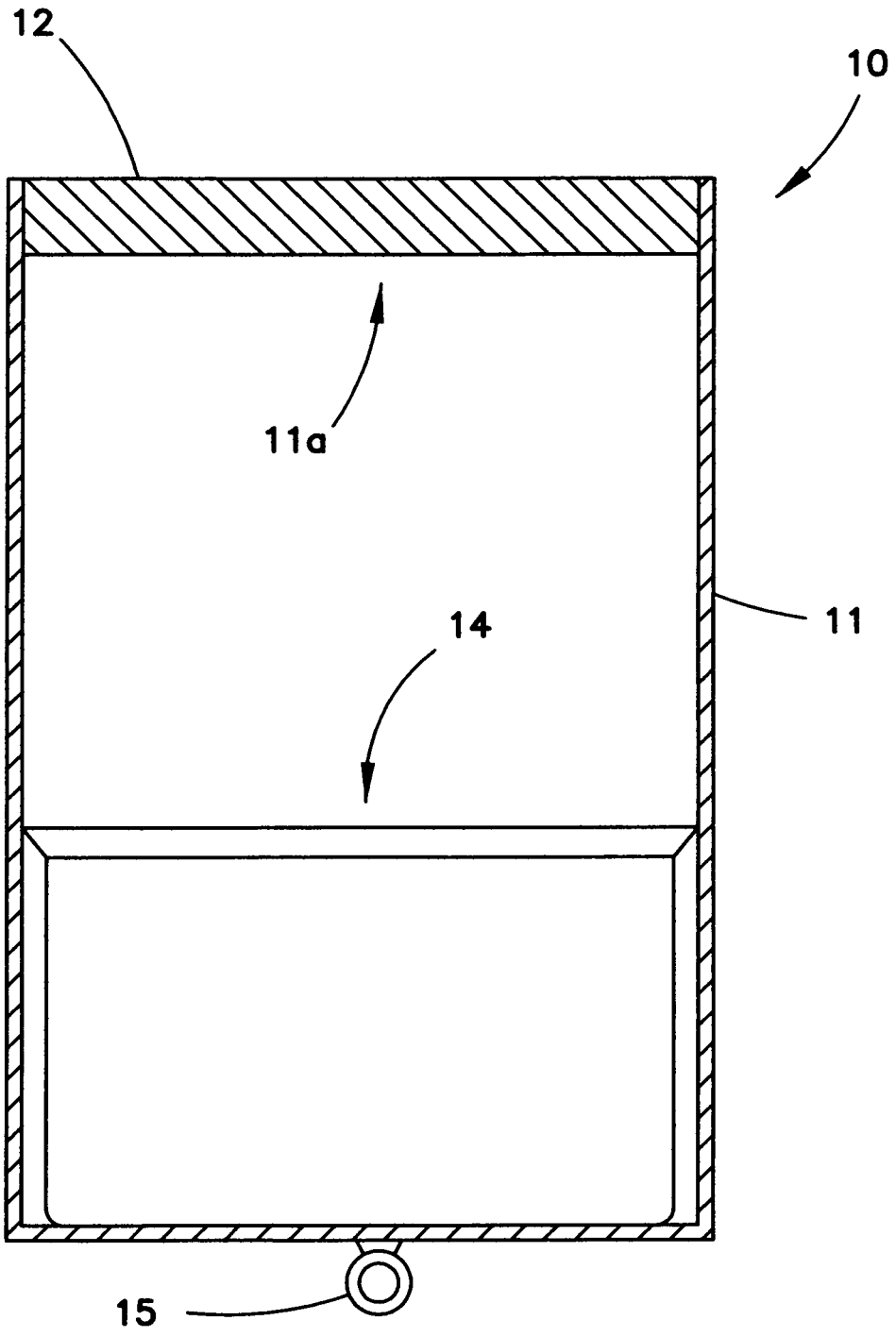
FIG. 3 is a cross-sectional drawing through the central axis of the memorial buoy assembly like that illustrated in FIG. 1, without a memorial plaque or statue, but with a separate additional cremains holder for the decedent's cremains carried in the container portion of the buoy assembly.

FIGS. 2 and 3 illustrate a simple buoy assembly 10 comprising only two parts, a lower container part 11 and an upper closure part 12, which can be attached to the open top of the lower part 11 to form a water-tight interior. In use, the two parts 11 and 12 are provided separately. In FIG. 2, the cremains 13 of a decedent can be poured into the bottom of the lower part 11 and provide ballast for the buoy assembly, and the upper closure part can be fastened in the open top 11*a* by a suitable water-resistant adhesive, or other applicable means, to render the interior of the lower part 11 with its enclosed cremains water-tight. The memorial buoy assembly of FIG. 3 differs from the FIG. 2 showing only by the use of a separate additional cremains holder 14, preferably also water-tight, into which the cremains are placed for subsequent placement of the cremains holder 14 and cremains into the lower part 11. The lower part 11 of the buoy assembly 10 can be formed from a corrosion-resistant metal, for example, aluminum, to provide a lower part with a cylindrical side wall by metal spinning, or drawing. The upper closure part 12 can be a disc of metal compatible with the metal of the lower part 11, which can be attached to the open top of the lower part, as shown in FIGS. 2 and 3, or it can be large enough to sit on top of the open top of the lower part 11, or it can also be formed by metal spinning or by machining to have a downwardly extending skirt to overlap the open end of the lower part. After the upper part 12 is in place on the lower part 11, it can be joined to the lower part by water-resistant adhesive or by an applicable metal joining method. When the lower part 11 is formed, it is formed with sufficient height so its water-tight interior can provide sufficient buoyancy to carry the weight of the upper and lower parts of the buoy assembly, the cremains and any cremains holder that may be used, with any memorial plaque or statue carried by the top of the buoy assembly above the surface of the water in which it is placed. After assembly of the buoy assembly 10, a memorial plaque or statue 10*a* (indicated by dashed lines in FIG. 2), if desired, can be fastened to the exterior of the upper closure part 12 by threaded fasteners or water-resistant adhesive. The lower container part 11 is preferably provided with an eyelet 15 fastened to the outer bottom surface of the lower container part 11 to permit the memorial buoy assembly to be anchored in a preferred location in a body of water for viewing.

Figure 4:
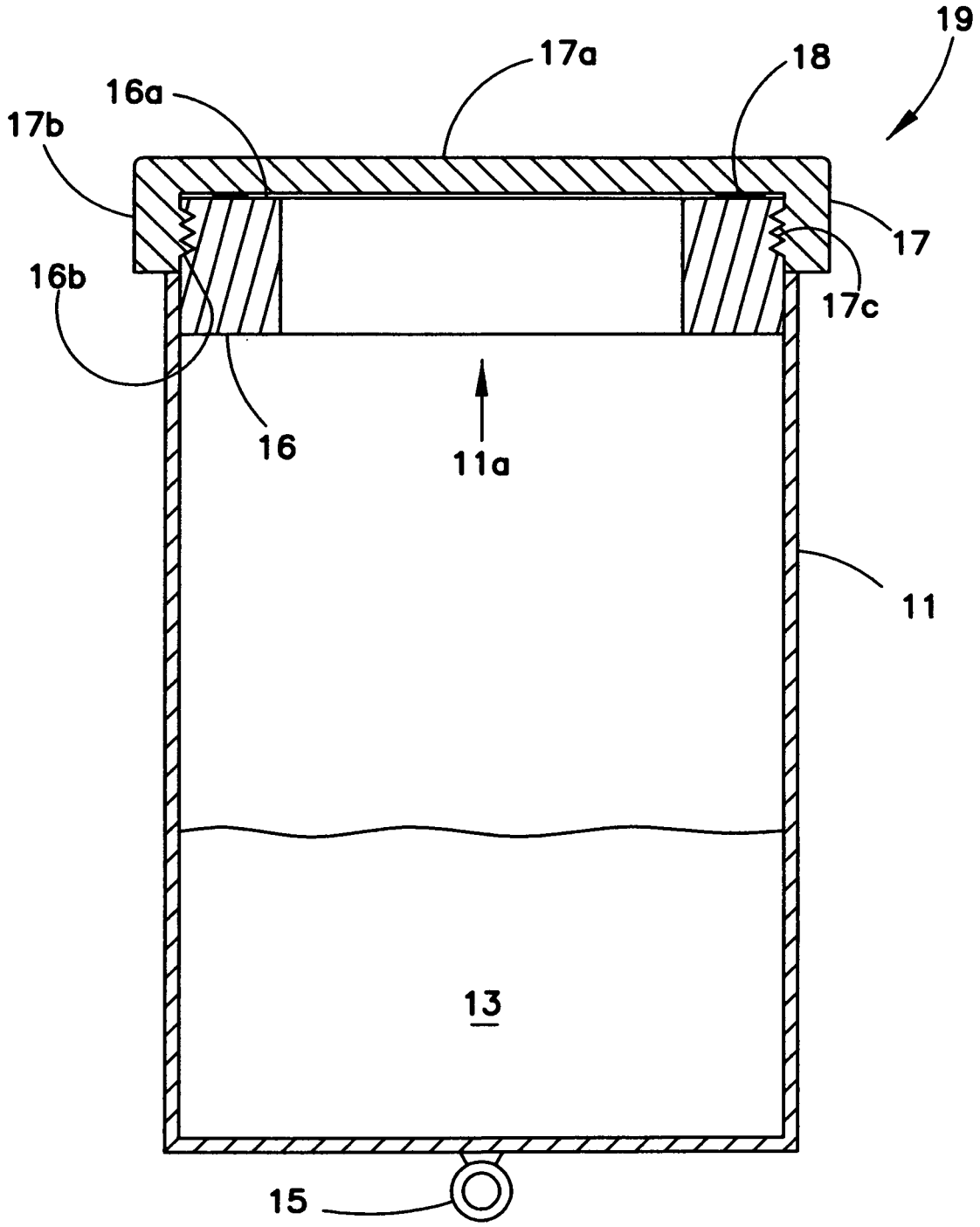
FIG. 4 is a cross-sectional drawing through the central axis of a memorial buoy assembly including a cremains container portion like the cremains container portions shown in FIGS. 2 and 3, but including an upper end piece adapted to cooperate with a removable closure cap to provide a removable water-tight closure for the cremains container portion.
Figure 5:
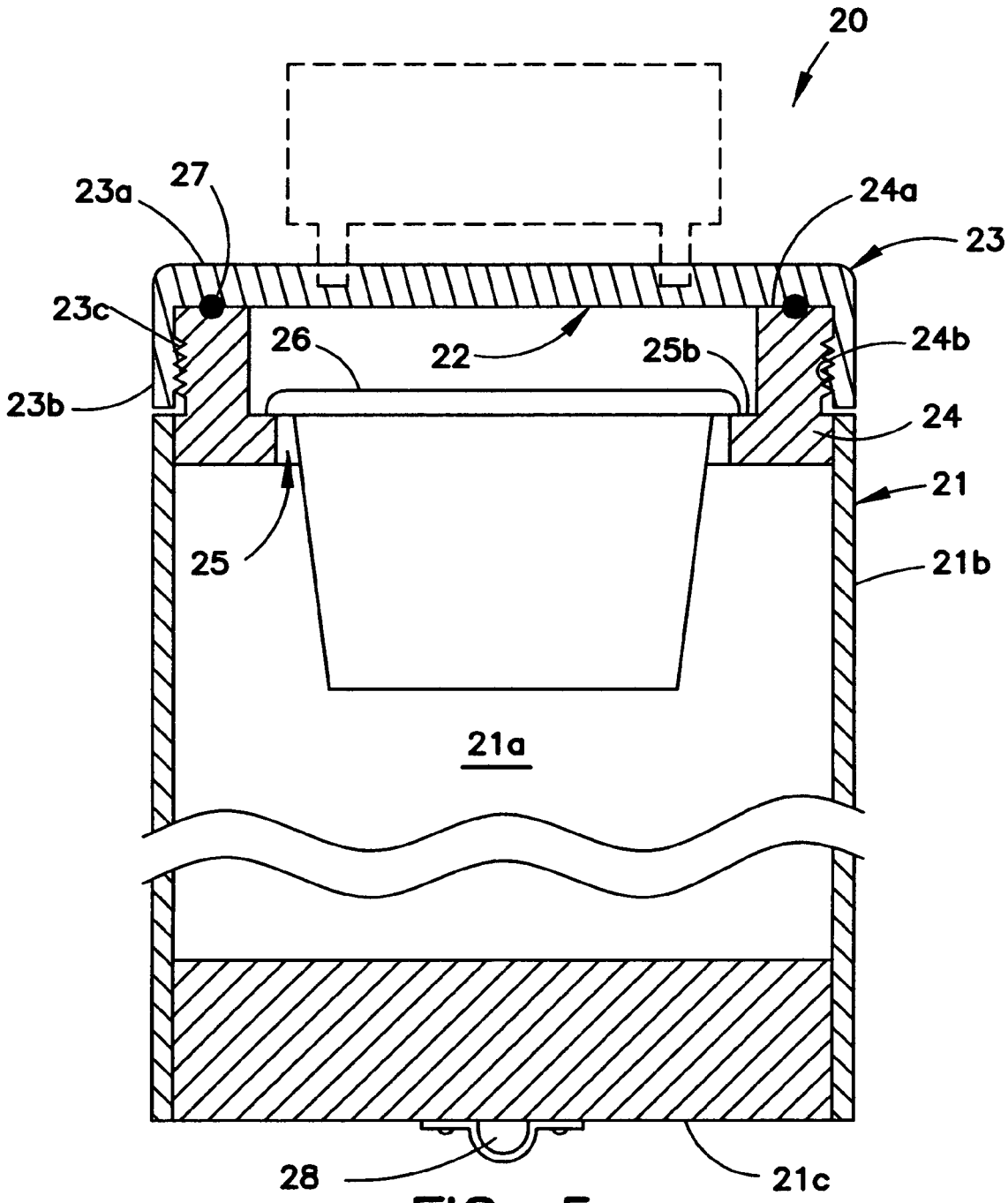
FIG. 5 is another memorial buoy assembly of the invention including an upper end piece adapted to cooperate with a removable cap to provide a removable water-tight closure for the interior of the buoy assembly and to carry, adjacent the top of the buoy assembly, a separate cremains holder and the cremains of a decedent.

The memorial buoy assemblies of FIG. 4 and FIG. 5 differ from the memorial buoy assemblies of FIGS. 2 and 3 by their inclusion of means for providing access to the cremains within the memorial buoy assemblies.

The FIG. 4 memorial buoy assembly 19 uses the same lower container part 11 as the memorial buoy assemblies of FIGS. 2 and 3, which can be formed, for example, by metal spinning or metal drawing. Unlike the memorial buoy assemblies of FIGS. 2 and 3, the memorial buoy assembly 19 of FIG. 4 includes, attached to its open upper end, a threaded upper end part 16 with a threaded outer surface 16*b* forming a sealable opening 11*a* of the lower container part 11 surrounded by a sealable end surface 16*a*, and further includes a threaded cap 17 forming a closed top 17*a* over the sealable opening 11*a* of the lower container part 11 and a downwardly-extending skirt 17*b* with internal threads 17*c* that mate the threads 16*b* of the threaded part 16. The closed top 17*a* of the threaded cap 17 can carry a seal 18 sized and positioned in the threaded cap 17 for engagement with the sealable end surface 16*a* of the threaded upper end part 16 to seal the open end 11*a* of the upper end part 16 and lower container part 11 when the threaded cap 17 is screwed onto the threaded upper part 16. The threaded upper part 16 and the mating threaded cap 17 form one means for closing the memorial buoy assembly and for providing access to the water-tight interior of the memorial buoy assembly.

FIG. 5 illustrates another somewhat more complicated buoy assembly embodiment 20 of the invention which provides a memorial buoy for cremains. Like the embodiments of FIGS. 2 and 3, the embodiment 20 of FIG. 5 forms a container 21 with water-tight interior 21*a* for carrying the cremains of a decedent, a sealable opening 22 to the container 21 for insertion of the cremains into the buoy assembly 20 and includes a closure 23 for the open top at the top of the memorial buoy assembly 20. Like the embodiments described above, the water-tight interior 21*a* of the FIG. 5 embodiment provides buoyancy for supporting the buoy assembly 20 in a body of water, preferably with its sealable opening 22 above the water surface. Also like the embodiments of FIGS. 2 and 3, a memorial plaque or statue (indicated by dashed lines) may be fastened on top of the closure 23 and carried above the surface of the water adjacent a water-side dwelling.

As illustrated by FIG. 5, the FIG. 5 embodiment has a container portion 21 formed by a tubular side wall 21*b* and a bottom end closure 21*c*, which is connected within the open bottom of the tubular side wall 21*b* by welding or the use of water-resistant adhesive. An upper end piece 24 is fastened within and at the top of the upper end of the tubular side wall 21*b* by welding or the use of a water-resistant adhesive to form a water-tight container. The upper end piece 24 provides the sealable opening 22 of the buoy assembly 20 with a sealable end surface 24*a* surrounding the sealable opening 22 and includes a central opening 25 formed with an interior wall portion 25*b* adapted to engage and support a cremains holder 26 centrally within the tubular body 21*b* and and further provides water-tight interior space 21*a* and above the bottom of the buoy assembly. The upper end piece 24 forms a sealable end surface 24*a* joined to the upper end of the tubular side wall 21*b* and includes a cylindrical threaded outer surface 24*b*. The FIG. 5 embodiment includes as its closure 23, a cap 23*a* with a threaded skirt 23*b* with internal threads 23*c* that mate the threads of the cylindrical threaded outer surface 24*b* of the upper end piece 24. The cap 23*a* can carry a seal 27 sized and located for sealing engagement with the sealable end surface 24*a* of the upper end piece 24 to provide a water-tight closure. Thus, the cap 23*a* may be screwed onto the upper end piece 24 to provide a water-tight interior 21*a* of the container 21 and may be unscrewed from the upper end piece 24 to permit access to, and, if desired, insertion and removal of the cremains container 26. The bottom closure 21*c* can be provided with an eyelet 28 to permit the memorial buoy assembly to be anchored in place in the water.

The invention is not limited to the embodiments illustrated and described above. For example, the memorial may have a triangular cross-section with the sealable opening in one of its sides. In this embodiment the cremains can be carried adjacent the junction of two of the three sides, and its third side can be carried adjacent the surface of the water where it may be adapted to provide a memorial to a deceased loved one. In addition, a cremains holder, if used, may be a bag formed with a thin, sealable flexible film of water impermeable material, such as polyethylene, the opening of which is sealed after the cremains are inserted. Such a bag may deform and carry the cremains adjacent the junction of two of the sides to provide a desirable ballast for the cremains container.

While the drawings and preceding description of the invention illustrate and describe memorial buoys formed from metals by metal manufacturing methods, memorial buoys of the invention can be formed from other materials, such as rubber, plastics, such as nylon, polyethylene, polypropylene, poly chloride, epoxies and the like, which generally resist corrosion by water, by forming methods, such as vulcanizing, blow molding, injection molding, casting and others well known in the art.

It is believed that the families of a cremated decedent will prefer that the cremains of their loved ones be carried in a cremains holder within a memorial buoy assembly, in a manner like that shown in FIGS. 3 and 5. Providing a separate water-tight cremains holder provides additional protection of the cremains from contamination should the memorial buoy develop a leak. In addition a separate cremains holder can be made with a decorative exterior which can be provided with a memorial message so if it is to be carried within a memorial buoy assembly with means for providing access to the interior of the memorial buoy assembly, the cremains holder can be removed from the memorial buoy assembly and placed in a dwelling place of a family member when the seasons no longer permit an enjoyable use of the water.

The size of a cremains holder will be governed by the size of the deceased loved one. "What size urn do I need", available on the internet at www.mainelyurns.com/what-size-cremation-urn.html, indicates that for each pound a decedent weighed, one cubic inch of volume is needed to store the cremains. For example, the cremains of a 240 pound decedent will need 240 cubic inches of storage volume in a cremains holder, and the cremains of a 50 pound child will require 50 cubic inches of volume in the cremains holder.

"I'm Burning Up How much will my ashes weigh?, available on the internet at www.slate.com/articles/news and politics/explainer/2008/07/im_bnurning up.html, indicates that the cremains of a decedent will weigh from 2 pounds all the way up to 10 pounds. The weight of the cremains of a decedent must be added to the weight of the memorial buoy assembly and any cremains holder in the memorial buoy assembly to determine the volume of the water-tight portion of the memorial buoy assembly needed to provide the desired displacement of water and buoyancy of the memorial buoy assembly and the amount by which the memorial buoy assembly extends above the water surface. Water has a density of about 0.04 pounds per cubic inch. The weight of the memorial buoy assembly can be determined by the volume of its parts and the densities of the materials from which its parts are made. Examples of metals from which the parts of memorial buoys can be made and their densities are: aluminum-density of about 0.10 pounds per cubic inch; steel-density of about 0.28 pounds per cubic inch; and bronze-density of about 0.32 pounds per cubic inch. For a memorial buoy to float, each pound of a memorial buoy assembly and its contents must be supported by at least an equal weight of displaced water, and to provide exposure of a memorial plaque, the weight of the water to be displaced when the memorial buoy is placed in the water must be less than the total weight of the water displaced when the memorial buoy is completely immersed, and this desired displacement of water can be calculated using the weight of the memorial buoy assembly, the dimensions of the water-tight portion of the memorial buoy assembly and the density of water, about 0.04 pounds per cubic inch. The dimensions and the resulting volume, in cubic inches, of the water-tight interior of the memorial buoy assembly as it accumulates from bottom to top along its central axis of the water-tight portion of the memorial assembly, multiplied by 0.04 pounds per cubic inch will be less by a selected amount than the total volume of water displaced when the memorial buoy assembly is totally submerged in water.

The descriptions and drawings of this application disclose examples of possible memorial buoy assemblies (and their parts) of the invention. It will be apparent to skilled artisans that many other possible embodiments of buoy assemblies can be devised using the invention.

The invention claimed is:

1. A memorial buoy for a deceased loved one, comprising a buoy assembly for forming, from a corrosion-resistant material, a water-tight interior for carrying, within the buoy assembly, the cremains of a deceased loved one, said buoy assembly having a sealable water-tight opening for insertion of the cremains within the water-tight interior, said water-tight interior providing buoyancy for supporting the buoy assembly and cremains adjacent beneath the surface of a body of water.

2. The memorial buoy of claim 1 wherein the cremains of the decedent is within a separate cremains holder carried within the water-tight interior of the buoy assembly.

3. The memorial buoy of claim 1 wherein the sealable water-tight opening comprises a removable water-tight closure for providing access to the water-tight interior of the buoy assembly.

4. The memorial buoy of claim 1 wherein the buoy assembly includes means for anchoring the buoy assembly in a selected location for the memorial presentation.

5. The memorial buoy of claim 2 wherein the cremains holder comprises a container with a lid, said container having a peripheral upper edge and said lid having a peripheral edge, said peripheral edges of said container and said lid being adapted to join together and form a water-tight seal for the enclosed cremains.

6. The memorial buoy of claim 1 wherein the water-tight interior is formed by a lower container portion with a tubular side wall portion at one end including said sealable water-tight opening.

7. The memorial buoy of claim 6 wherein said sealable water-tight opening includes a threaded side wall portion, and said buoy assembly includes a removable water-tight closure with a threaded portion for threaded water-tight engagement with the threaded sidewall portion of the sealable opening.

8. The memorial buoy of claim 7 wherein the tubular side wall portion carries, adjacent the sealable water-tight opening, a seal member engageble by the removable threaded water-tight closure when threaded onto the sealable water-tight opening.

9. The memorial buoy of claim 2 wherein the buoy assembly includes a tubular body and an upper end piece fastened to one end of the tubular body with a peripheral water-tight interconnection, said upper end piece providing said sealable water-tight opening of the buoy assembly and further including a central opening adapted to engage and support the water-tight cremains holder centrally within the tubular body and above its bottom.

10. The memorial buoy of claim 9, wherein the upper end piece forms a sealable end surface around the sealable water-tight opening of the buoy assembly and includes a cylindrical threaded outer surface around the upper end of the tubular body, and wherein the buoy assembly includes a cap with cylindrical skirt with internal threads that engage the cylindrical threaded outer surface of the upper end piece, said cap carrying a seal located and sized for sealing engagement with the sealable end surface of the upper end piece, wherein the cap may be screwed onto the upper end piece and seal the sealable opening to provide the water-tight interior of the buoy assembly and may be unscrewed from the upper end piece to permit access to and, if desired, insertion and removal of the cremains holder from the buoy assembly.

11. The memorial buoy of claim 10, wherein the water-tight interior is dimensioned to provide buoyancy selected to carry the memorial buoy with the water-tight opening above the surface of the water.

12. A method for providing a water-borne memorial with the cremains of a loved one, comprising, providing a water-tight container for the cremains of a loved one, placing the cremains of the loved one inside the water-tight container through a closeable opening in the water-tight container, providing a closure adapted to engage the closeable opening and render the closeable opening water-tight, said water-tight container having sufficient water-tight volume and buoyancy, when carrying the cremains of the loved one, to provide a visible memorial in a body of water in which it is placed, attaching the closure to the container to close the closeable opening and render the container water-tight, selecting a location in a body of water where family and friends of the cremated loved frequent, and anchoring the water-container at the selected location where it can provide a visible memorial to the cremated loved one.

13. The method of claim 12 further comprising providing a memorial on the water-tight container that can be seen at the selected location.

14. A memorial for carrying the cremains of a loved one in water, comprising a corrosion-resistant container for the cremains of the deceased loved one, said container including a container portion forming an opening for the insertion of the cremains, a closure for the opening in the container portion, said closure and said container portion providing engagable portions that, when engaged, prevent the passage of water and render the container water-tight, said container portion providing sufficient water-tight volume to provide a memorial adjacent beneath the surface of the water in which it is placed and means on said container for attaching an anchor for retaining the memorial in a selected location in a body of water.

15. The memorial of claim 14 further comprising a cremains holder for the cremains of the deceased loved one sized to fit within and be carried by the container.

16. The memorial of claim 15 wherein the cremains holder is water-tight.

17. The memorial of claim 14 wherein the container carries a memorial portion extending from the container to provide a visible memorial above the surface of water in which it is placed.

18. The memorial of claim 14 wherein the container has sufficient water-tight volume to carry its contained cremains adjacent the surface of a body of water in which it is placed.

19. The memorial of claim 18 wherein the container includes a memorial message on its outer surface which is visible.

* * * * *